US012048964B2

(12) United States Patent
Endoh et al.

(10) Patent No.: US 12,048,964 B2
(45) Date of Patent: Jul. 30, 2024

(54) BONDING MATERIAL AND BONDING METHOD USING SAME

(71) Applicant: Dowa Electronics Materials Co., Ltd., Tokyo (JP)

(72) Inventors: Keiichi Endoh, Tokyo (JP); Minami Kanasugi, Tokyo (JP); Hideyuki Fujimoto, Tokyo (JP); Satoru Kurita, Tokyo (JP)

(73) Assignee: DOWA ELECTRONICS MATERIALS CO., LTD., Tokyo (JP)

( * ) Notice: Subject to any disclaimer, the term of this patent is extended or adjusted under 35 U.S.C. 154(b) by 312 days.

(21) Appl. No.: 16/335,361

(22) PCT Filed: Sep. 27, 2017

(86) PCT No.: PCT/JP2017/034837
§ 371 (c)(1),
(2) Date: Mar. 21, 2019

(87) PCT Pub. No.: WO2018/062220
PCT Pub. Date: Apr. 5, 2018

(65) Prior Publication Data

US 2019/0283129 A1 Sep. 19, 2019

(30) Foreign Application Priority Data

Sep. 30, 2016 (JP) ..... 2016-194332
Sep. 25, 2017 (JP) ..... 2017-183123

(51) Int. Cl.
*B22F 1/052* (2022.01)
*B22F 1/00* (2022.01)
(Continued)

(52) U.S. Cl.
CPC ..... *B22F 1/00* (2013.01); *B22F 1/052* (2022.01); *B22F 1/054* (2022.01); *B22F 1/056* (2022.01);
(Continued)

(58) Field of Classification Search
CPC .. B23K 35/025; B23K 35/22; B23K 35/3006; B23K 35/3013; B23K 35/302;
(Continued)

(56) References Cited

U.S. PATENT DOCUMENTS 10,308,856 B1 * 6/2019 Wang ..... C09K 5/14
2012/0298009 A1 * 11/2012 Endoh ..... B23K 35/3618 106/287.18
(Continued)

FOREIGN PATENT DOCUMENTS

EP 1339073 A1 8/2003
EP 2455171 A1 5/2012
(Continued)

OTHER PUBLICATIONS

International search report for patent Application No. PCT/JP2017/034837 dated Nov. 16, 2017.
(Continued)

*Primary Examiner* — Vanessa T. Luk
(74) *Attorney, Agent, or Firm* — Bachman & LaPointe, P.C.

(57) ABSTRACT

In a bonding material of a metal paste containing metal particles, a solvent and a dispersant, the metal particles containing first metal particles having an average primary particle diameter of 1 to 40 nm, second metal particles having an average primary particle diameter of 41 to 110 nm, and third metal particles having an average primary particle diameter of 120 nm to 10 μm, the weight percentages of the first, second and third metal particles being 1.4
(Continued)

to 49% by weight, 36% by weight or less, and 50 to 95% by weight, respectively, with respect to the total 100% by weight of the metal particles, and the weight ratio of the first metal particles to the second metal particles being 14/36 or more.

17 Claims, 1 Drawing Sheet

(51) Int. Cl.

| | |
|---|---|
| ***B22F 1/054*** | (2022.01) |
| ***B22F 1/07*** | (2022.01) |
| ***B22F 1/102*** | (2022.01) |
| ***B22F 1/107*** | (2022.01) |
| ***B22F 7/02*** | (2006.01) |
| ***B22F 7/06*** | (2006.01) |

(52) U.S. Cl.
CPC ..... *B22F 1/07* (2022.01); *B22F 1/102* (2022.01); *B22F 1/107* (2022.01); *B22F 7/02* (2013.01); *B22F 7/064* (2013.01); *B22F 2301/10* (2013.01); *B22F 2301/15* (2013.01); *B22F 2301/25* (2013.01)

(58) Field of Classification Search
CPC ..... B23K 35/3033; B22F 1/00; B22F 1/0003; B22F 1/0007; B22F 1/0011; B22F 1/0014; B22F 1/0018; B22F 1/0022; B22F 1/0044; B22F 1/0048; B22F 1/0059; B22F 1/0062; B22F 1/0074; B22F 1/02; B22F 2207/11; B22F 2207/13; B22F 2301/10; B22F 2301/15; B22F 2301/25; B22F 2301/255; B22F 1/052; B22F 1/10; B22F 1/102; B22F 1/103; B22F 1/107; B22F 1/16
See application file for complete search history.

(56) References Cited

U.S. PATENT DOCUMENTS

| | | | | |
|---|---|---|---|---|
| 2015/0028085 | A1* | 1/2015 | Endoh | B22F 1/0062 228/224 |
| 2016/0136763 | A1* | 5/2016 | Endoh | B22F 1/0014 228/248.1 |
| 2018/0102341 | A1* | 4/2018 | Konno | H01L 24/83 |

FOREIGN PATENT DOCUMENTS

| | | | | | |
|---|---|---|---|---|---|
| JP | 2008161907 | A | | 7/2008 | |
| JP | 2011021255 | A | | 2/2011 | |
| JP | 2011080147 | A | | 4/2011 | |
| JP | 2011175781 | A | | 9/2011 | |
| JP | 2011175871 | A | * | 9/2011 | |
| JP | 2013108408 | A1 | | 5/2015 | |
| JP | 2016000861 | A | | 1/2016 | |
| JP | 2016054098 | A | * | 4/2016 | |
| JP | 2016054098 | A | | 4/2016 | |
| JP | 5976684 | B2 | | 8/2016 | |
| WO | WO-2014204013 | A1 | * | 12/2014 | B23K 35/3006 |
| WO | 2015194536 | A1 | | 12/2015 | |

OTHER PUBLICATIONS

European patent application No. 17856169.2-1103 dated Nov. 12, 2019.

* cited by examiner

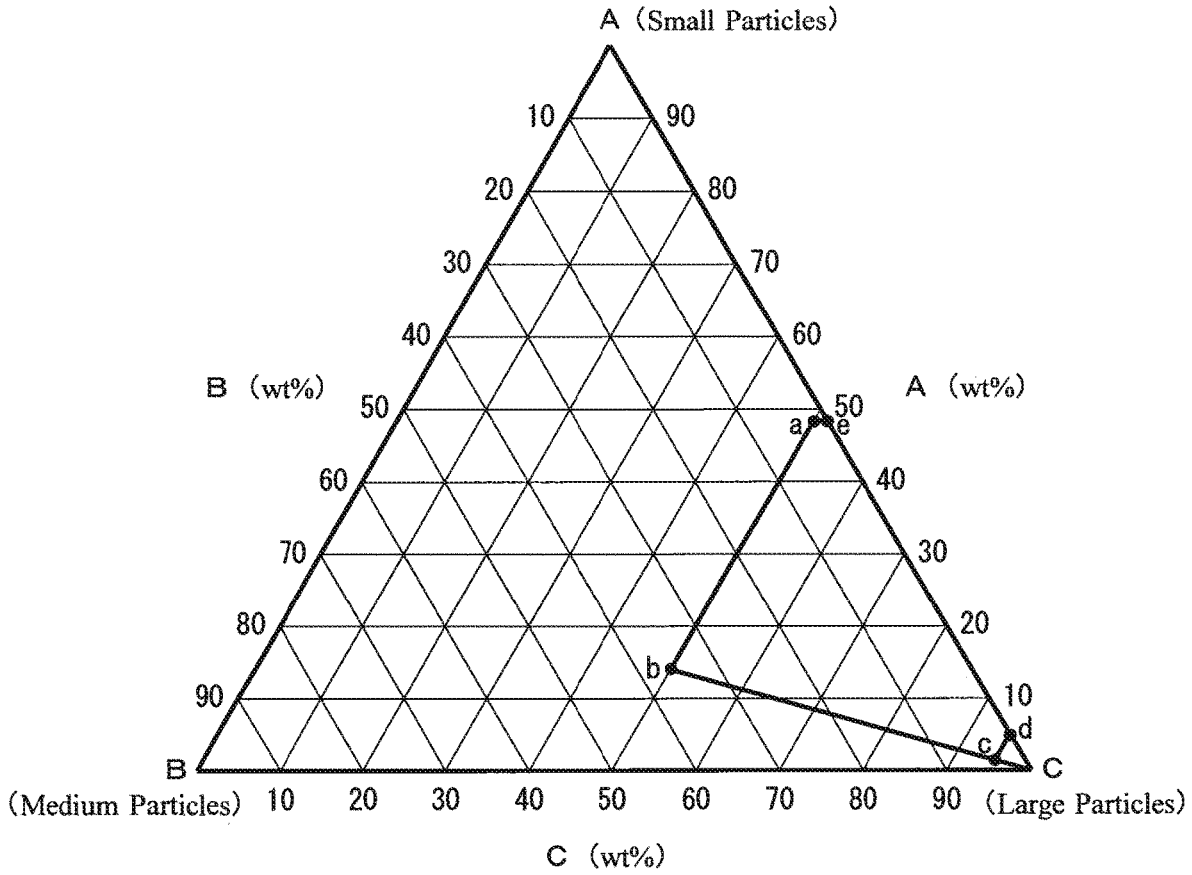
A (Small Particles)
B (wt%)
A (wt%)
B
(Medium Particles)
C
(Large Particles)
C (wt%)
10
20
30
40
50
60
70
80
90
a
b
c
d
e

BONDING MATERIAL AND BONDING METHOD USING SAME

TECHNICAL FIELD

The present invention relates generally to a bonding material and a bonding method using the same. More specifically, the invention relates to a bonding material of a metal paste containing metal particles, such as fine silver particles, and a method for bonding an electronic part, such as an Si chip, on a metal substrate, such as a copper substrate, using the bonding material.

BACKGROUND ART

In recent years, it is proposed that a metal paste containing metal particles, such as fine silver particles, is used as a bonding material to be arranged between articles to be heated to sinter a metal, such as silver, in the bonding material to bond the articles to each other (see, e.g., Patent Documents 1-3).

When such a bonding material is used for fixing an electronic part, such as an Si chip, on a metal substrate, such as a copper substrate, a metal paste containing metal particles, such as fine silver particles, dispersed in a solvent is applied on the substrate to be heated to remove the solvent to form a pre-dried film on the substrate, and then, the electronic part is arranged thereon. Then, the pre-dried film is heated while applying a pressure on the electronic part, so that it is possible to bond the electronic part to the substrate via a metal bonding layer.

PRIOR ART DOCUMENT(S)

Patent Document(s)

Patent Document 1: Japanese Patent Laid-Open No. 2011-80147 (Paragraph Numbers 0014-0020)

Patent Document 2: Japanese Patent Laid-Open No. 2011-21255 (Paragraph Numbers 0032-0042)

Patent Document 3: Japanese Patent No. 5976684 (Paragraph Numbers 0014-0022)

SUMMARY OF THE INVENTION

Problem to be Solved by the Invention

If the bonding materials of Patent Documents 1-2 are used for bonding copper substrates to each other or for bonding a copper substrate to a copper chip, they can be satisfactorily bonded to each other. However, if the bonding materials of Patent Documents 1-2 are used for bonding an Si chip to a metal substrate, such as a copper substrate, there are some cases where it is not possible to satisfactorily bond them to each other due to the generation of voids in a metal bonding layer or on the boundary between the metal bonding layer and the Si chip. In addition, the viscosities of the bonding materials of Patent Documents 1-2 are too high, so that there are some cases where it is not possible to satisfactorily print them on a substrate by a predetermined printing system, such as an inkjet printing system. Moreover, if the bonding material of Patent Document 3 is used for bonding an Si chip to a metal substrate, such as a copper substrate, there are some cases where it is not satisfactorily bond them to each other due to the generation of voids in the metal bonding layer or the like unless the Si chip is arranged on a pre-dried film to be burned, the pre-dried film being formed by volatilizing a solvent to some extent by pre-burning after the bonding material is applied on the metal substrate.

It is therefore an object of the present invention to eliminate the aforementioned conventional problems and to provide a bonding material, which is easily printed on a metal substrate, such as a copper substrate, and which can satisfactorily bond an Si chip to the metal substrate by preventing voids from being generated in a metal bonding layer and/or on the boundary between the metal bonding layer and the Si chip or the metal substrate even if no pre-burning is carried out when the Si chip is bonded to the metal substrate, and a bonding method using the same.

Means for Solving the Problem

In order to accomplish the aforementioned object, the inventors have diligently studied and found that it is possible to provide a bonding material, which is easily printed on a metal substrate, such as a copper substrate, and which can satisfactorily bond an Si chip to the metal substrate, and a bonding method using the same, if the bonding material of a metal paste comprises a solvent, a dispersant and metal particles which contain first metal particles having an average primary particle diameter of 1 to 40 nm, second metal particles having an average primary particle diameter of 41 to 110 nm, and third metal particles having an average primary particle diameter of 120 nm to 10 μm, the weight percentages of the first, second and third metal particles are 1.4 to 49% by weight, 36% by weight or less, and 50 to 95% by weight, respectively, with respect to the total 100% by weight of the metal particles, and the weight ratio of the first metal particles to the second metal particles is 14/36 or more. Thus, the inventors have made the present invention.

According to the present invention, there is provided a bonding material of a metal paste comprising: metal particles which contain first metal particles having an average primary particle diameter of 1 to 40 nm, second metal particles having an average primary particle diameter of 41 to 110 nm, and third metal particles having an average primary particle diameter of 120 nm to 10 μm; a solvent; and a dispersant, wherein the weight percentages of the first, second and third metal particles are 1.4 to 49% by weight, 36% by weight or less, and 50 to 95% by weight, respectively, with respect to the total 100% by weight of the metal particles, and the weight ratio of the first metal particles to the second metal particles is 14/36 or more.

In this bonding material, each of the first metal particles is preferably coated with an organic compound having a carbon number of not greater than 8, and each of the second metal particles is coated with an organic compound having a carbon number of not greater than 8. Each of the second metal particles is preferably coated with an organic compound having a carbon number of not greater than 8 while each of the third metal particles is preferably coated with an organic compound having a carbon number of not less than 9, the weight percentage of the first metal particles being preferably 1.4 to 25% by weight with respect to the total 100% by weight of the metal particles. In these cases, the organic compound having the carbon number of not greater than 8 is preferably a saturated or unsaturated fatty acid having a carbon number of 1 to 6, and more preferably hexanoic acid or sorbic acid. The weight percentage of the second metal particles is 2 to 17% by weight with respect to the total 100% by weight of the metal particles. The solvent is preferably a polar solvent. The polar solvent is preferably one or more selected from the group consisting of 1-decanol, 1-dodecanol, 2-ethyl-1,3-hexanediol and 2-methyl-butane-1,3,4-triol. The dispersant is preferably one or more selected from the group consisting of carboxylic acid dispersants and phosphate ester dispersants. The total content of the metal particles in the bonding material is preferably 87 to 97% by weight. The metal particles are preferably gold particles, silver particles, copper particles or nickel particles, more preferably silver particles or copper particles, and most preferably silver particles.

According to the present invention, there is provided a bonding method comprising the steps of: arranging the above-described bonding material between articles; and heating the bonding material to sinter a metal therein to form a metal bonding layer to bond the articles to each other with the metal bonding layer.

According to the present invention, there is provided a method for producing a bonding material of a metal paste which comprises metal particles, a solvent and a dispersant, the method comprising the steps of: preparing metal particles which contain first metal particles having an average primary particle diameter of 1 to 40 nm, second metal particles having an average primary particle diameter of 41 to 110 nm, and third metal particles having an average primary particle diameter of 120 nm to 10 μm; causing the weight percentages of the first, second and third metal particles to be 1.4 to 49% by weight, 36% by weight or less, and 50 to 95% by weight, respectively, with respect to the total 100% by weight of the metal particles while causing the weight ratio of the first metal particles to the second metal particles to be 14/36 or more; and mixing the metal particles with a solvent and a dispersant.

In this method for producing a bonding material, each of the second metal particles is preferably coated with an organic compound having a carbon number of not greater than 8 while each of the third metal particles is preferably coated with an organic compound having a carbon number of not less than 9, the weight percentage of the first metal particles being preferably 1.4 to 25% by weight with respect to the total 100% by weight of the metal particles. The weight percentage of the second metal particles is preferably 2 to 17% by weight with respect to the total 100% by weight of the metal particles. The solvent is preferably a polar solvent.

Throughout the specification, the expression "the average primary particle diameter of metal particles" means an average value of primary particle diameters of metal particles obtained on the basis of a transmission electron microphotograph (TEM image) or a scanning electron microphotograph (SEM image).

Effects of the Invention

According to the present invention, it is possible to provide a bonding material, which is easily printed on a metal substrate, such as a copper substrate, and which can satisfactorily bond an Si chip to the metal substrate by preventing voids from being generated in a metal bonding layer and/or on the boundary between the metal bonding layer and the Si chip or the copper substrate even if no pre-burning is carried out when the Si chip is bonded to the metal substrate, and a bonding method using the same.

BRIEF DESCRIPTION OF THE DRAWINGS

FIG. 1 is a triangular graph showing the ranges of the weight percentages of the first metal particles (small particles A), second metal particles (medium particles B) and third metal particles (large particles C) as triangular coordinates in the preferred embodiment of a bonding material according to the present invention.

MODE FOR CARRYING OUT THE INVENTION

In the preferred embodiment of a bonding material according to the present invention, the bonding material of a metal paste comprises metal particles, a solvent and a dispersant, the metal particles comprising first metal particles having an average primary particle diameter of 1 to 40 nm, second metal particles having an average primary particle diameter of 41 to 110 nm, and third metal particles having an average primary particle diameter of 120 nm to 10 μm, the weight percentages of the first, second and third metal particles being 1.4 to 49% by weight, 36% by weight or less, and 50 to 95% by weight, respectively, with respect to the total 100% by weight of the metal particles, and the weight ratio (weight of the first metal particles/weight of the second metal particles) of the first metal particles to the second metal particles being 14/36 or more.

That is, in the preferred embodiment of a bonding material according to the present invention, as shown in FIG. 1, the weight percentages (% by weight) of the first metal particles (small particles A), second metal particles (medium particles B) and third metal particles (large particles C) are in a pentagonal region (containing the outline of the pentagonal region) obtained by connecting a point a (49, 1, 50), a point b (14, 36, 50), a point c (1.4, 3.6, 95), a point d (5, 0, 95) and a point e (49, 0, 51) by straight lines in this order, the points a, b, c, d and e being arranged on the coordinates of a triangle ABC (triangular coordinates) having vertexes which are a point A (100, 0, 0) at which the weight percentages of the first, second and third metal particles are 100% by weight, 0% by weight and 0% by weight, respectively, a point B (0, 100, 0) at which the weight percentages of the first, second and third metal particles are 0% by weight, 100% by weight and 0% by weight, respectively, and a point C at which the weight percentages of the first, second and third metal particles are 0% by weight, 0% by weight and 100% by weight, respectively. Furthermore, in the triangular coordinates shown in FIG. 1, the straight line bC (except for the point C) shows a case where the weight ratio (weight of the first metal particles/weight of the second metal particles) of the first metal particles to the second metal particles (medium particles B) is 14/36.

The weight percentages (% by weight) of the first metal particles (small particles A), second metal particles (medium particles B) and third metal particles (large particles C) are preferably 2 to 40% by weight, 32% by weight or less, and 50 to 95% by weight, respectively, with respect to the total 100% by weight of the metal particles. The weight percentages of the first, second and third metal particles are more preferably 2.5 to 30% by weight, 29% by weight or less, and 50 to 95% by weight, respectively, with respect to the total 100% by weight of the metal particles. In particular, when the bonding material is used for bonding an Si chip to a metal substrate, the weight percentage of the first metal particles is preferably 1.4 to 25% by weight with respect to the total 100% by weight of the metal particles in order to lower the viscosity of the bonding material to allow the bonding material to be easily printed on the metal substrate. When the bonding material is used for bonding an Si chip to a metal substrate, the weight percentage of the second metal particles is preferably 17% by weight or less with respect to the total 100% by weight of the metal particles in order to satisfactorily bond the Si chip to the metal substrate, and the weight percentage of the second metal particles is more preferably 2 to 17% by weight with respect to the total 100% by weight of the metal particles in order to lower the viscosity of the bonding material to allow the bonding material to be easily printed on the metal substrate.

The average primary particle diameter of the first metal particles (small particles) is 1 to 40 nm. This average primary particle diameter is preferably 5 to 30 nm and more preferably 10 to 20 nm in order to satisfactorily bond an Si chip to a metal substrate by preventing voids from being generated when the bonding material is used for bonding the Si chip to the metal substrate. The average primary particle diameter of the second metal particles (medium particles) is 41 to 110 nm. This average primary particle diameter is preferably 50 to 105 nm and more preferably 55 to 100 nm in order to allow the bonding material to be easily printed on a metal substrate and to satisfactorily bond an Si chip to the metal substrate when the bonding material is used for bonding the Si chip to the metal substrate. Each of the first metal particles (small particles) and second metal particles (medium particles) is preferably coated with an organic compound having a carbon number of not greater than 8 (the organic compounds of the first and second metal particles being preferably different types of organic compounds) since they are easily to agglutinate due to the small particle diameter thereof. Such an organic compound is preferably a saturated or unsaturated fatty acid having a carbon number of 1 to 6, and more preferably hexanoic acid or sorbic acid. The average primary particle diameter of the third metal particles (large particles) is 120 nm to 10 μm. This average primary particle diameter is preferably 0.2 to 5 μm and more preferably 0.3 to 3 μm in order to allow the bonding material to be easily printed on a metal substrate when the bonding material is used for bonding an Si chip to the metal substrate. Each of the third metal particles (large particles) may be coated with an organic compound (such as a fatty acid or an amine). In particular, when the bonding material is used for bonding an Si chip to a metal substrate, the weight percentage of the first metal particles is preferably 1.4 to 25% by weight with respect to the total 100% by weight of the metal particles while the second and third metal particles are preferably coated with an organic compound having a carbon number of 8 or less and an organic compound having a carbon number of 9 or more, respectively, in order to lower the viscosity of the bonding material to allow the bonding material to be easily printed on the metal substrate. If the carbon number of the organic compound coating the third metal particles is larger than the carbon number of the organic compound coating the second metal particles (if the organic compound coating the third metal particles has a longer main chain in its molecule than that of the organic compound coating the second metal particles), the viscosity of the bonding material can be lowered in comparison with a case where the first and third metal particles are added without adding the second metal particles. As such an organic compound having a carbon number of 9 or more, there may be used fatty acids (such as carboxylic acids) and amines having a carbon number of 9 to 20, such as lauric acid, stearic acid, palmitic acid, oleic acid, linolic acid, linolenic acid, laurylamine, undecylamine and dodecylamine. The organic compound having the carbon number of 9 or more is preferably an amine or carboxylic acid having a carbon number of 12 to 20 and more preferably an amine or carboxylic acid having a carbon number of 14 to 18 in order to lower the viscosity of the bonding material. The metal particles are preferably gold particles, silver particles, copper particles or nickel particles (in order to satisfactorily bond an Si chip to a metal substrate when the bonding material is used for bonding the Si chip to the metal substrate), more preferably silver particles or copper particles (in order to allow the bonding material to have good conductivity), and most preferably silver particles (in order to improve the resistance to oxidation of the bonding material). The total content of the metal particles in the bonding material is preferably 87 to 97% by weight and more preferably 90 to 95% by weight (in order to satisfactorily bond an Si chip to a metal substrate when the bonding material is used for boding the Si chip to the metal substrate).

Furthermore, the average primary particle diameter of the metal particles can be calculated, for example, from the primary particle diameters of optionally selected 100 or more of metal particles (the diameter of a circle corresponding to a circle having the same area as that of each of the metal particles) on an image (SEM image or TEM image) obtained by observing the metal particles by means of a transmission electron microscope (TEM) (JEM-1011 produced by Japan Electron Optics Laboratory Ltd.) or a scanning electron microscope (SEM) (S-4700 produced by Hitachi Hi-Technologies Corporation) at a predetermined magnification. The calculation of the average primary particle diameter (number average) of the metal particles can be carried out, for example, by an image analysis software (A-image-kun (registered trademark) produced by Asahi Kasei Engineering Corporation).

The content of the solvent in the metal paste is preferably 1 to 10% by weight and more preferably 2 to 8% by weight (in order to obtain a metal paste in which the metal particles can sintered to form a metal bonding layer and which has such a viscosity that the bonding material is easily printed). As this solvent, there may be used any one of various polar solvents (dispersing media). For example, as the polar solvent, there may be used water, alcohol, polyol, glycol ether, 1-methylpyrrolidinone, pyridine, terpineol, butyl carbitol, butyl carbitol acetate, texanol, phenoxypropanol, diethylene glycol monobutyl ether, diethylene glycol monobutyl ether acetate, γ-butyrolactone, ethylene glycol monomethyl ether acetate, ethylene glycol monoethyl ether acetate, methoxybutyl acetate, methoxypropyl acetate, diethylene glycol monoethyl ether acetate, ethyl lactate, 1-octanol or the like. As such a polar solvent, there is preferably used 1-decanol, 1-dodecanol, 1-tetradecanol, 3-methyl-1,3-butanediol-3-hydroxy-3-methylbutyl acetate, 2-ethyl-1,3-hexanediol, hexyl diglycol, 2-ethylhexyl glycol, dibutyl glycol, glycerin, dihydroxy terpineol, dihydroxy terpineol acetate, 2-methyl-butane-2,3,4-triol (isoprene triol A (IPTL-A produced by Nippon Terpene Chemicals, Inc.)), 2-methyl-butane-1,3,4-triol (isoprene triol B (IPTL-B produced by Nippon Terpene Chemicals, Inc.)), Terusolve IPG-2Ac (produced by Nippon Terpene Chemicals, Inc.), Terusolve MTPH (produced by Nippon Terpene Chemicals, Inc.), Terusolve DTO-210 (produced by Nippon Terpene Chemicals, Inc.), Terusolve THA-90 (produced by Nippon Terpene Chemicals, Inc.), Terusolve THA-70 (produced by Nippon Terpene Chemicals, Inc.), Terusolve TOE-100 (produced by Nippon Terpene Chemicals, Inc.), dihydroterpinyl oxyethanol (produced by Nippon Terpene Chemicals, Inc.), terpinyl methyl ether (produced by Nippon Terpene Chemicals, Inc.), dihydroterpinyl methyl ether (produced by Nippon Terpene Chemicals, Inc.) or the like, and there is more preferably used at least one of 1-decanol, 1-dodecanol, 2-ethyl-1,3-hexanediol, and 2-methyl-butane-1,3,4-triol (isoprene triol B (IPTL-B)).

The content of the dispersant in the metal paste is preferably 0.01 to 2% by weight and more preferably 0.03 to 0.7% by weight. As this dispersant, there may be used any one of commercially available dispersants. For example, there may be used View Light LCA-H, LCA-25NH (produced by Sanyo Chemical Industries, Ltd.), FLOREN DOPA-15B (produced by Kyoeisha Chemical Co., Ltd.), SOLPLUS AX5, SOLSPARSE 9000, SOLSIX 250 (produced by Lubrizol Japan Co., Ltd.), EFKA4008 (produced by EFKAADIDIBS), AJISPAR-PA 111 (produced by Ajinomoto Fine-Tecno Co., Inc.), TEXAPHOR-UV21 (produced by Gognics Japan Co., Ltd.), Disper BYK 2020, BYK 220S (produced by BYK-Chemie Japan Co., Ltd.), DISPARON 1751N, HIPRARD ED-152 (produced by Kusumoto Chemicals, Ltd.), FTX-2075, FTERGENT (produced by NEOS Co., Ltd.), AS-1100 (produced by Toagosei Co., Ltd.), KAOCERA 2000, KDH-154, MX-2045L, HOMOGENOL L-18, LEODOL SP-010V (produced by Kao Corporation), EPAN U103, CYANOL DC902B, NOIGEN EA-167, PLYSURF A219B (produced by DKS Co., Ltd.), MEGAFAC F-477 (produced by DIC Corporation), SILFACE SAG503A, DYNOL 604 (produced by Nissin Chemical Co., Ltd.), SN SPARSE 2180, SN LEVELER S-906 (produced by SAN NOPCO LIMITED), S-386 (produced by AGC SEIMI CHEMICAL CO., LTD.), SOLPLUS D540, SOLSPARSE 44000, SOLSPARSE 43000, SOLSPARSE 20000, SOLSPARSE 27000 (produced by Lubrizol Japan Co., Ltd.), Cirrasol G-265, Hypermer KD1, Hypermer KD2, Hypermer KD3, Hypermer KD4, Hypermer KD9, Hypermer KD11, Hypermer KD12, Hypermer KD16, Hypermer KD57, Armer 163 (produced by CRODA Corporation), Synperoic T701, Zephrym PD2246SF, Zephrym 3300B (produced by CRODA Corporation), SANSPARL PS-2, CARRYBON L400 (produced by Sanyo Chemical Industries, Ltd.), Disper BYK 2055, Disper BYK 2155, Disper BYK 2055, Disper BYK 193, BYKP 105, BYKPR 606, Disper BYK 2013, Disper BYK 108, Disper BYK 109, Disper BYK 145, Disper BYK 2008, Disper BYK 2096, Disper BYK 2152, BYK-LPC 2214, BYK-LPC 22124, BYK-LPC 22126, BYK-LPC 22125 (produced by BYK-Chemie Japan Co., Ltd.) or the like. There is preferably used at least one of carboxylic acid dispersants and phosphate ester dispersants.

The viscosity of the metal paste is preferably 5 to 2500 Ps·s, more preferably 5 to 1000 Pa·s and most preferably 10 to 500 Pa·s when it is measured at 25° C. and 2 $s^{-1}$. The viscosity of the metal paste is preferably 1 to 150 Pa·s, more preferably 1 to 100 Pa·s and most preferably 2 to 35 Pa·s when it is measured at ° C. and 20 $s^{-1}$.

In the preferred embodiment of a method for producing a bonding material according to the present invention, there is produced a bonding material of a metal paste containing metal particles, a solvent and a dispersant. In this method, there are prepared metal particles which comprises first metal particles having an average primary particle diameter of 1 to 40 nm, second metal particles having an average primary particle diameter of 41 to 110 nm, and third metal particles having an average primary particle diameter of 120 nm to 10 μm. The weight percentages of the first, second and third metal particles are caused to be 1.4 to 49% by weight, 36% by weight or less, and 50 to 95% by weight, respectively, with respect to the total 100% by weight of the metal particles, and the weight ratio of the first metal particles to the second metal particles is caused to be 14/36 or more. Then, the metal particles are mixed (and kneaded) with a solvent and a dispersant.

In the preferred embodiment of a bonding method according to the present invention, the above-described bonding material is arranged between articles, e.g., between an Si chip (which has a bonded surface to a metal substrate, the bonded surface being silver-plated or gold-plated) and the metal substrate (such as a copper substrate having a bonded surface to the Si chip, the bonded surface being silver-plated or gold-plated, or a pure copper substrate) to be heated to sinter a metal, such as silver, in the bonding material to form a metal bonding layer to bond the articles (e.g., the Si chip and the metal substrate) to each other with the metal bonding layer.

Specifically, the above-described bonding material can be applied on at least one of two articles (by printing or the like) to be arranged between the articles to be heated at a temperature of 210 to 400° C., preferably at a temperature of 210 to 300° C., to sinter a metal in the metal paste to form a metal bonding layer to bond the articles to each other with the metal bonding layer. Alternatively, the bonding material may be applied on at least one of two articles to be heated at a temperature of 60 to 200° C., preferably at a temperature of 80 to 170° C., to be dried to form a pre-dried film, and then, the other article may be arranged on the pre-dried film to heat the pre-dried film at a temperature of 210 to 400° C., preferably at a temperature of 210 to 300° C., to sinter a metal in the metal paste to form a metal bonding layer to bond the articles to each other with the metal bonding layer. Furthermore, while the heating of the bonding material (or the pre-dried film) is carried out, a pressure may be applied between the articles although it is not required to apply the pressure between the articles. The articles can be bonded to each other even if the heating of the bonding material (or the pre-dried film) is carried out at the atmosphere although they can be bonded to each other even if the heating is carried out at an inert atmosphere, such as an atmosphere of nitrogen.

If the above-described preferred embodiment of a bonding material according to the present invention is used for bonding an Si chip to a metal substrate, such as a copper substrate, it is possible to easily print the bonding material on the metal substrate, and it is possible to prevent voids from being generated in a metal bonding layer and on the boundary between the metal bonding layer and the Si chip to satisfactorily bond them to each other even if no pre-burning is carried out. In particular, even if the area of the bonded surface of the Si chip to the metal substrate is large (when the area of the bonded surface is preferably 25 $mm^2$ or less, more preferably 1 to 25 $mm^2$ and most preferably 4 to 25 $mm^2$), it is possible to satisfactorily bond them to each other.

EXAMPLES

Examples of a bonding material and a bonding method using the same according to the present invention will be described below in detail.

Example 1

First, 3400 g of water was put in a 5 L reaction vessel, and nitrogen gas was caused to flow at a flow rate of 3000 mL/min. for 600 seconds into water in the reaction vessel from a nozzle, which was provided on the lower portion of the reaction vessel, to remove dissolved oxygen. Then, nitrogen gas was fed into the reaction vessel at a flow rate of 3000 mL/min. from the upper portion of the reaction vessel to allow the atmosphere in the reaction vessel to be an atmosphere of nitrogen, and the temperature of water in the reaction vessel was adjusted to be 60° C. while stirring is carried out by means of a stirring rod with an impeller, the stirring rod being provided in the reaction vessel. After 7 g of ammonia water containing 28% by weight of ammonia was added to water in the reaction vessel, it is stirred for 1 minute to obtain a uniform solution. Then, as an organic compound, 45.5 g (a molar ratio of 1.98 to silver) of hexanoic acid (produced by Wako Pure Chemical Industries, Ltd.), which was a saturated fatty acid, was added to the solution in the reaction vessel to be dissolved therein by stirring for 4 minutes. Then, 50% by weight of hydrazine hydrate (produced by Otsuka Chemical Co., Ltd.) 23.9 g (an equivalent of 4.82 with respect to silver) was added thereto as a reducing agent to obtain a reducing agent solution.

An aqueous silver nitrate solution was prepared as an aqueous silver salt solution by dissolving 33.8 g of silver nitrate crystal (produced by Wako Pure Chemical Industries, Ltd.) in 180 g of water. The temperature of the aqueous silver salt solution was adjusted to be 60° C. Then, 0.00008 g (1 ppm of copper with respect to silver) of copper nitrate tri-hydrate (produced by Wako Pure Chemical Industries, Ltd.) was added to the aqueous silver salt solution. Furthermore, the addition of copper nitrate tri-hydrate was carried out so that a solution prepared by diluting an aqueous copper nitrate tri-hydrate solution at a high concentration to a certain extent was added to cause the amount of copper to be a target amount.

Then, the above-described aqueous silver salt solution was added to the above-described reducing agent solution at a stroke to start a reduction while the solution was stirred. After about 10 seconds from the starting of the reduction, the variation in color of a slurry being a reaction solution was completed. The aging of the solution was carried out for 10 minutes while the solution was stirred, and thereafter, the stirring of the solution was stopped. Then, the solid-liquid separation of the solution was carried out by suction filtration to obtain a solid body. The solid body was washed with pure water to be dried at 40° C. for 12 hours to obtain a dried powder of fine silver particles (silver nanoparticles) (coated with hexanoic acid). Furthermore, the percentage of silver in the fine silver particles was calculated to be 97% by weight on the basis of the weight of the fine silver particles after hexanoic acid was removed by heating. The average primary particle diameter of the fine silver particles was obtained to be 17 nm by means of a transmission electron microscope (TEM).

Then, 180.0 g of pure water was put in a 300 mL beaker, and 33.6 g of silver nitrate (produced by Toyo Kagaku Inc.) was added thereto to be dissolved to prepare an aqueous silver nitrate solution as a raw material solution.

Then, 3322.0 g of pure water was put in a 5 L beaker, and the temperature thereof was raised to 40° C. while dissolved oxygen was removed by blowing nitrogen gas into the pure water for 30 minutes. To this pure water, 44.8 g of sorbic acid (produced by Wako Pure Chemical Industries, Ltd.) was added as an organic compound (for coating fine silver particles), and thereafter, 7.1 g of 28% ammonia water (produced by Wako Pure Chemical Industries, Ltd.) was added thereto as a stabilizing agent.

While the aqueous solution was stirred after the ammonia water was added, 14.91 g of hydrous hydrazine having a purity of 80% (produced by Otsuka Chemical Co., Ltd.) was added thereto as a reducing agent after 5 minutes from the addition of the ammonia water (from the reaction initiation), to prepare an aqueous reducing agent containing solution as a reducing solution. After 9 minutes from the reaction initiation, the raw material solution (aqueous silver nitrate solution), the temperature of which was adjusted to be 40° C., was added to the reducing solution (aqueous reducing agent containing solution) at a stroke to be allowed to react with the reducing solution, and stirred for 80 minutes. Thereafter, the temperature of the solution was raised at a temperature raising rate of 1° C./min. from 40° C. to ° C., and the stirring of the solution was stopped.

After the aggregates of the fine silver particles (silver nanoparticles) coated with sorbic acid were thus formed, a liquid containing the aggregates of the fine silver particles was filtered by a No. 5C filter paper, and then, a recovery obtained by filtration was washed with pure water to obtain the aggregates of the fine silver particles. The aggregates of the fine silver particles were dried at 80° C. for 12 hours in a vacuum dryer to obtain a dried powder of the aggregates of the fine silver particles. The dried powder of the aggregates of the fine silver particles thus obtained was broken to adjust the size of the secondary aggregates thereof. Furthermore, the average primary particle diameter of the fine silver particles was obtained by means of a scanning electron microscope (SEM). As a result, the average primary particle diameter was 85 nm.

Then, there were mixed 14.5 g of the dried powder of the fine silver particles (first silver particles (small particles)) (coated with hexanoic acid) having the average primary particle diameter of 17 nm, 7.5 g of the dried powder of the fine silver particles (second silver particles (medium particles)) (coated with sorbic acid) having the average primary particle diameter of 85 nm, 70 g of silver particles (coated with oleic acid) (AG2-1C produced by DOWA ELECTRONICS MATERIALS CO., LTD.) having a micron size (an average primary particle diameter of 0.3 μm obtained from the SEM image thereof) serving as the third silver particles (large particles), 0.5 g of butoxyethoxy acetic acid (BEA) (produced by Tokyo Chemical Industry Co., Ltd.) serving as a first dispersant (carboxylic acid dispersant), 0.05 g of a phosphate ester dispersant (SOLPLUS D540 produced by The Lubrizol Corporation) serving as a second dispersant, 2.45 g of 1-decanol (produced by Wako Pure Chemical Industries, Ltd.) serving as a first solvent, 1.5 g of octanediol (2-ethyl-1,3-hexanediol produced by Kyowa Hakko Chemical Co., Ltd.) serving as a second solvent, and 3.5 g of 2-methyl-butane-1,3,4-triol (isoprene triol B (IPTL-B)) (produced by Nippon Terpene Chemicals, Inc.) serving as a third solvent. The mixture thus obtained was kneaded, and the kneaded mixture was caused to pass through a three-roll mill to obtain a bonding material of a silver paste. Furthermore, the total content of the first, second and third silver particles in the bonding material (silver paste) was 92% by weight, and the weight ratio (first silver particles: second silver particles:third silver particles) of the first, second and third silver particles was 16:8:76.

The viscosity of this bonding material (silver paste) was obtained by a rheometer (viscoelasticity measuring apparatus) (HAAKE RheoStress 600 produced by Thermo Scientific, Inc.), using a cone having a cone diameter of 35 mm and a cone angle of 2°). As a result, the viscosity measured at 25° C. was 309 (Pa·s) at 2 $s^{-1}$ and 26 (Pa·s) at 20 $s^{-1}$. The ratio (thixotropic ratio) Ti of the viscosity at 2 $s^{-1}$ to the viscosity at 20 $s^{-1}$ (viscosity at 2 $s^{-1}$/viscosity at 20 $s^{-1}$) was 11.7 when the viscosity was measure at 25° C., and the printability (print quality) of the bonding material (silver paste) was good.

Then, there are prepared a pure copper substrate and a substrate prepared by plating one surface (a surface to be bonded) of a pure copper substrate with silver, and there are prepared two Si chips, the back (a surface to be bonded) of each of the Si chips being plated with silver (and having an area of about 18 $mm^2$). Then, a metal mask having a thickness of 50 μm was arranged on each of the substrates to apply the above-described bonding material (silver paste) on each of the substrates so as to have the same size as the area of the back of the Si chip and a thickness of 50 μm by means of a metal squeegee. Then, after each of the Si chips was arranged on the bonding material, an inert oven was used for raising the temperature of the bonding material at a temperature raising rate of 0.05° C./s from 25° C. to 250° C. in an atmosphere of nitrogen to hold the temperature thereof at 250° C. for 60 minutes to burn the bonding material to sinter silver in the silver paste to form a silver bonding layer to bond the Si chip to each of the substrates with the silver bonding layer.

With respect to each of two bonded articles thus obtained, the presence of voids in the silver bonding layer (in the interior of the silver bonding layer and on the boundaries between the silver bonding layer and the substrate and between the silver bonding layer and the Si chip) was observed from an image (C-SAM image) obtained by means of an ultrasonic microscope (C-SAM) (D9500 produced by SONOSCAN, INC.). As a result, no voids were observed in each of the two bonded articles, and the Si chip was satisfactorily bonded to the substrate in each of the two bonded articles. Furthermore, it was determined that there were no voids so that the Si chip was satisfactorily bonded to the substrate if the whole surface of the C-SAM image was black, that there was voids in the central portion so that the bonded state in the central portion was not good if the central portion of the C-SAM image was white, and that there were voids in the whole surface so that the bonded state was not good (or the Si chip was peeled off from the substrate) if the whole surface of the C-SAM image was while.

Example 2

A bonding material was produced by the same method as that in Example 1, except that the amounts of the first, second and third silver particles in the bonding material (silver paste) were 14.5 g, 0 g and 77.5 g, respectively (the weight ratio of the first, second and third silver particles (first silver particles:second silver particles:third silver particles) was 16:0:84). The viscosity of the bonding material was obtained by the same method as that in Example 1. As a result, the viscosity measured at 25° C. was 712 (Pa·s) at 2 $s^{-1}$ and 49 (Pa·s) at 20 $s^{-1}$. The thixotropic ratio Ti was 14.6, and the printability (print quality) of the bonding material (silver paste) was good. The bonding material thus obtained was used for producing two bonded articles by the same method as that in Example 1, and the presence of voids in the silver bonding layer was observed by the same method as that in Example 1. As a result, no voids were observed in each of the two bonded articles, and the Si chip was satisfactorily bonded to the substrate in each of the two bonded articles.

Example 3

A bonding material was produced by the same method as that in Example 1, except that the amounts of the first, second and third silver particles in the bonding material (silver paste) were 19.78 g, 0 g and 72.22 g, respectively (the weight ratio of the first, second and third silver particles (first silver particles:second silver particles:third silver particles) was 22:0:78). The viscosity of the bonding material was obtained by the same method as that in Example 1. As a result, the viscosity measured at 25° C. was 1034 (Pa·s) at 2 $s^{-1}$ and 47 (Pa·s) at 20 $s^{-1}$. The thixotropic ratio Ti was 22.0, and the printability (print quality) of the bonding material (silver paste) was good. The bonding material thus obtained was used for producing two bonded articles by the same method as that in Example 1, and the presence of voids in the silver bonding layer was observed by the same method as that in Example 1. As a result, no voids were observed in each of the two bonded articles, and the Si chip was satisfactorily bonded to the substrate in each of the two bonded articles.

Example 4

A bonding material was produced by the same method as that in Example 1, except that the amounts of the first, second and third silver particles in the bonding material (silver paste) were 14.5 g, 12.5 g and 65.0 g, respectively (the weight ratio of the first, second and third silver particles (first silver particles:second silver particles:third silver particles) was 16:14:70). The viscosity of the bonding material was obtained by the same method as that in Example 1. As a result, the viscosity measured at 25° C. was 357 (Pa·s) at 2 $s^{-1}$ and 22 (Pa·s) at 20 $s^{-1}$. The thixotropic ratio Ti was 16.0, and the printability (print quality) of the bonding material (silver paste) was good. The bonding material thus obtained was used for producing two bonded articles by the same method as that in Example 1, and the presence of voids in the silver bonding layer was observed by the same method as that in Example 1. As a result, no voids were observed in each of the two bonded articles, and the Si chip was satisfactorily bonded to the substrate in each of the two bonded articles.

Example 5

A bonding material was produced by the same method as that in Example 1, except that the amounts of the first, second and third silver particles in the bonding material (silver paste) were 14.75 g, 14.75 g and 62.5 g, respectively (the weight ratio of the first, second and third silver particles (first silver particles:second silver particles:third silver particles) was 16:16:68). The viscosity of the bonding material was obtained by the same method as that in Example 1. As a result, the viscosity measured at 25° C. was 287 (Pa·s) at 2 $s^{-1}$ and 25 (Pa·s) at 20 $s^{-1}$. The thixotropic ratio Ti was 11.6, and the printability (print quality) of the bonding material (silver paste) was good. The bonding material thus obtained was used for producing two bonded articles by the same method as that in Example 1, and the presence of voids in the silver bonding layer was observed by the same method as that in Example 1. As a result, no voids were observed in each of the two bonded articles, and the Si chip was satisfactorily bonded to the substrate in each of the two bonded articles.

Example 6

A bonding material was produced by the same method as that in Example 1, except that the amounts of the first, second and third silver particles in the bonding material (silver paste) were 12.5 g, 7.5 g and 72.0 g, respectively (the weight ratio of the first, second and third silver particles (first silver particles:second silver particles:third silver particles) was 14:8:78). The viscosity of the bonding material was obtained by the same method as that in Example 1. As a result, the viscosity measured at 25° C. was 211 (Pa·s) at 2 $s^{-1}$ and 17 (Pa·s) at 20 $s^{-1}$. The thixotropic ratio Ti was 12.4, and the printability (print quality) of the bonding material (silver paste) was good. The bonding material thus obtained was used for producing two bonded articles by the same method as that in Example 1, and the presence of voids in the silver bonding layer was observed by the same method as that in Example 1. As a result, no voids were observed in each of the two bonded articles, and the Si chip was satisfactorily bonded to the substrate in each of the two bonded articles.

Example 7

A bonding material was produced by the same method as that in Example 1, except that the amounts of the first, second and third silver particles in the bonding material (silver paste) were 7.25 g, 7.25 g and 77.5 g, respectively (the weight ratio of the first, second and third silver particles (first silver particles:second silver particles:third silver particles) was 8:8:84). The viscosity of the bonding material was obtained by the same method as that in Example 1. As a result, the viscosity measured at 25° C. was 118 (Pa·s) at 2 $s^{-1}$ and 15 (Pa·s) at 20 $s^{-1}$. The thixotropic ratio Ti was 8.1, and the printability (print quality) of the bonding material (silver paste) was good. The bonding material thus obtained was used for producing two bonded articles by the same method as that in Example 1, and the presence of voids in the silver bonding layer was observed by the same method as that in Example 1. As a result, no voids were observed in each of the two bonded articles, and the Si chip was satisfactorily bonded to the substrate in each of the two bonded articles.

Example 8

A bonding material was produced by the same method as that in Example 1, except that the amounts of the first, second and third silver particles in the bonding material (silver paste) were 14.5 g, 26.8 g and 50.7 g, respectively (the weight ratio of the first, second and third silver particles (first silver particles:second silver particles:third silver particles) was 16:29:55). The viscosity of the bonding material was obtained by the same method as that in Example 1. As a result, the viscosity measured at 25° C. was 28 (Pa·s) at 2 $s^{-1}$ and 9 (Pa·s) at 20 $s^{-1}$. The thixotropic ratio Ti was 3.0, and the printability (print quality) of the bonding material (silver paste) was good. The bonding material thus obtained was used for producing two bonded articles by the same method as that in Example 1, and the presence of voids in the silver bonding layer was observed by the same method as that in Example 1. As a result, no voids were observed in the bonded article having the Si chip bonded to the silver-plated copper substrate, and the Si chip was satisfactorily bonded to the substrate thereof. However, voids were observed in the bonded article having the Si chip bonded to the copper substrate which was not plated with silver, and the Si chip was not satisfactorily bonded to the substrate thereof.

Example 9

A bonding material was produced by the same method as that in Example 1, except that the amounts of the first, second and third silver particles in the bonding material (silver paste) were 14.5 g, 17.5 g and 60.0 g, respectively (the weight ratio of the first, second and third silver particles (first silver particles:second silver particles:third silver particles) was 16:19:65). The viscosity of the bonding material was obtained by the same method as that in Example 1. As a result, the viscosity measured at 25° C. was 96 (Pa·s) at 2 $s^{-1}$ and 20 (Pa·s) at 20 $s^{-1}$. The thixotropic ratio Ti was 4.8, and the printability (print quality) of the bonding material (silver paste) was good. The bonding material thus obtained was used for producing two bonded articles by the same method as that in Example 1, and the presence of voids in the silver bonding layer was observed by the same method as that in Example 1. As a result, no voids were observed in the bonded article having the Si chip bonded to the silver-plated copper substrate, and the Si chip was satisfactorily bonded to the substrate thereof. However, voids were observed in the bonded article having the Si chip bonded to the copper substrate which was not plated with silver, and the Si chip was not satisfactorily bonded to the substrate thereof.

Example 10

A bonding material was produced by the same method as that in Example 1, except that the amounts of the first, second and third silver particles in the bonding material (silver paste) were 7.5 g, 9.75 g and 74.75 g, respectively (the weight ratio of the first, second and third silver particles (first silver particles:second silver particles:third silver particles) was 8:11:81). The viscosity of the bonding material was obtained by the same method as that in Example 1. As a result, the viscosity measured at 25° C. was 86 (Pa·s) at 2 $s^{-1}$ and 13 (Pa·s) at 20 $s^{-1}$. The thixotropic ratio Ti was 6.6, and the printability (print quality) of the bonding material (silver paste) was good. The bonding material thus obtained was used for producing two bonded articles by the same method as that in Example 1, and the presence of voids in the silver bonding layer was observed by the same method as that in Example 1. As a result, no voids were observed in each of the two bonded articles, and the Si chip was satisfactorily bonded to the substrate in each of the two bonded articles.

Example 11

A bonding material was produced by the same method as that in Example 1, except that the amounts of the first, second and third silver particles in the bonding material (silver paste) were 4.5 g, 7.5 g and 80.0 g, respectively (the weight ratio of the first, second and third silver particles (first silver particles:second silver particles:third silver particles) was 5:8:87). The viscosity of the bonding material was obtained by the same method as that in Example 1. As a result, the viscosity measured at 25° C. was 62 (Pa·s) at 2 $s^{-1}$ and 13 (Pa·s) at 20 $s^{-1}$. The thixotropic ratio Ti was 4.7, and the printability (print quality) of the bonding material (silver paste) was good. The bonding material thus obtained was used for producing two bonded articles by the same method as that in Example 1, and the presence of voids in the silver bonding layer was observed by the same method as that in Example 1. As a result, no voids were observed in each of the two bonded articles, and the Si chip was satisfactorily bonded to the substrate in each of the two bonded articles.

Example 12

A bonding material was produced by the same method as that in Example 1, except that the amounts of the first, second and third silver particles in the bonding material (silver paste) were 27.6 g, 0 g and 64.4 g, respectively (the weight ratio of the first, second and third silver particles (first silver particles:second silver particles:third silver particles) was 30:0:70). The viscosity of the bonding material was obtained by the same method as that in Example 1. As a result, the viscosity measured at 25° C. was 2135 (Pa·s) at 2 $s^{-1}$ and 127 (Pa·s) at 20 $s^{-1}$. The thixotropic ratio Ti was 16.9, and the printability (print quality) of the bonding material (silver paste) was good. The bonding material thus obtained was used for producing two bonded articles by the same method as that in Example 1, and the presence of voids in the silver bonding layer was observed by the same method as that in Example 1. As a result, no voids were observed in each of the two bonded articles, and the Si chip was satisfactorily bonded to the substrate in each of the two bonded articles.

Example 13

A bonding material was produced by the same method as that in Example 1, except that the amounts of the first, second and third silver particles in the bonding material (silver paste) were 27.6 g, 18.4 g and 46.0 g, respectively (the weight ratio of the first, second and third silver particles (first silver particles:second silver particles:third silver particles) was 30:20:50). The viscosity of the bonding material was obtained by the same method as that in Example 1. As a result, the viscosity measured at 25° C. was 2186 (Pa·s) at 2 $s^{-1}$ and 96 (Pa·s) at 20 $s^{-1}$. The thixotropic ratio Ti was 22.8, and the printability (print quality) of the bonding material (silver paste) was good. The bonding material thus obtained was used for producing two bonded articles by the same method as that in Example 1, and the presence of voids in the silver bonding layer was observed by the same method as that in Example 1. As a result, no voids were observed in the bonded article having the Si chip bonded to the silver-plated copper substrate, and the Si chip was satisfactorily bonded to the substrate thereof. However, voids were observed in the bonded article having the Si chip bonded to the copper substrate which was not plated with silver, and the Si chip was not satisfactorily bonded to the substrate thereof.

Example 14

A bonding material was produced by the same method as that in Example 1, except that the amounts of the first, second and third silver particles in the bonding material (silver paste) were 2.3 g, 2.3 g and 87.4 g, respectively (the weight ratio of the first, second and third silver particles (first silver particles:second silver particles:third silver particles) was 2.5:2.5:95). The viscosity of the bonding material was obtained by the same method as that in Example 1. As a result, the viscosity measured at 25° C. was 37 (Pa·s) at 2 $s^{-1}$ and 11 (Pa·s) at 20 $s^{-1}$. The thixotropic ratio Ti was 3.4, and the printability (print quality) of the bonding material (silver paste) was good. The bonding material thus obtained was used for producing two bonded articles by the same method as that in Example 1, and the presence of voids in the silver bonding layer was observed by the same method as that in Example 1. As a result, no voids were observed in each of the two bonded articles, and the Si chip was satisfactorily bonded to the substrate in each of the two bonded articles.

Example 15

A bonding material was produced by the same method as that in Example 1, except that silver particles (coated with sorbic acid) (Superfine Silver Powder-2 produced by DOWA ELECTRONICS MATERIALS CO., LTD.) having a micron size (an average primary particle diameter of 0.3 μm obtained from the SEM image thereof) was used as the third silver particles (large particles) in place of the silver particles (coated with oleic acid) (AG2-1C produced by DOWA ELECTRONICS MATERIALS CO., LTD.) having the micron size (the average primary particle diameter of 0.3 μm obtained from the SEM image thereof). The viscosity of the bonding material was obtained by the same method as that in Example 1. As a result, the viscosity measured at 25° C. was 826 (Pa·s) at 2 $s^{-1}$ and (Pa·s) at 20 $s^{-1}$. The thixotropic ratio Ti was 12.0, and the printability (print quality) of the bonding material (silver paste) was good.

Comparative Example 1

A bonding material was produced by the same method as that in Example 1, except that the amounts of the first, second and third silver particles in the bonding material (silver paste) were 4.5 g, 17.5 g and 70.0 g, respectively (the weight ratio of the first, second and third silver particles (first silver particles:second silver particles:third silver particles) was 5:19:76). The viscosity of the bonding material was obtained by the same method as that in Example 1. As a result, the viscosity measured at 25° C. was 20 (Pa·s) at 2 $s^{-1}$ and 8 (Pa·s) at 20 $s^{-1}$. The thixotropic ratio Ti was 2.4, and the printability (print quality) of the bonding material (silver paste) was good. The bonding material thus obtained was used for producing two bonded articles by the same method as that in Example 1, and the presence of voids in the silver bonding layer was observed by the same method as that in Example 1. As a result, voids were observed in each of the two bonded articles, and the Si chip was not satisfactorily bonded to the substrate in each of the two bonded articles.

Comparative Example 2

A bonding material was produced by the same method as that in Example 1, except that the amounts of the first, second and third silver particles in the bonding material (silver paste) were 9.2 g, 27.6 g and 55.2 g, respectively (the weight ratio of the first, second and third silver particles (first silver particles:second silver particles:third silver particles) was 10:30:60). The viscosity of the bonding material was obtained by the same method as that in Example 1. As a result, the viscosity measured at 25° C. was 13 (Pa·s) at 2 $s^{-1}$ and 7 (Pa·s) at 20 $s^{-1}$. The thixotropic ratio Ti was 1.7, and the printability (print quality) of the bonding material (silver paste) was good. The bonding material thus obtained was used for producing two bonded articles by the same method as that in Example 1, and the presence of voids in the silver bonding layer was observed by the same method as that in Example 1. As a result, voids were observed in each of the two bonded articles, and the Si chip was not satisfactorily bonded to the substrate in each of the two bonded articles.

Comparative Example 3

A bonding material was produced by the same method as that in Example 1, except that the amounts of the first, second and third silver particles in the bonding material (silver paste) were 27.6 g, 27.6 g and 36.8 g, respectively (the weight ratio of the first, second and third silver particles (first silver particles:second silver particles:third silver particles) was 30:30:40). The viscosity of the bonding material was attempted to be obtained by the same method as that in Example 1. However, it was not possible to measure the viscosity thereof since it exceeds the measurement upper limit, and the printability (print quality) of the bonding material (silver paste) was not good. The bonding material thus obtained was used for producing two bonded articles by the same method as that in Example 1, and the presence of voids in the silver bonding layer was observed by the same method as that in Example 1. As a result, no voids were observed in the bonded article having the Si chip bonded to the silver-plated copper substrate, and the Si chip was satisfactorily bonded to the substrate thereof. However, voids were observed in the bonded article having the Si chip bonded to the copper substrate which was not plated with silver, and the Si chip was not satisfactorily bonded to the substrate thereof.

Comparative Example 4

A bonding material was produced by the same method as that in Example 1, except that the amounts of the first, second and third silver particles in the bonding material (silver paste) were 46.0 g, 9.2 g and 36.8 g, respectively (the weight ratio of the first, second and third silver particles (first silver particles:second silver particles:third silver particles) was 50:10:40). The viscosity of the bonding material was attempted to be obtained by the same method as that in Example 1. However, it was not possible to measure the viscosity thereof since it exceeds the measurement upper limit, and the printability (print quality) of the bonding material (silver paste) was not good. The bonding material thus obtained was used for producing two bonded articles by the same method as that in Example 1, and the presence of voids in the silver bonding layer was observed by the same method as that in Example 1. As a result, no voids were observed in the bonded article having the Si chip bonded to the silver-plated copper substrate, and the Si chip was satisfactorily bonded to the substrate thereof. However, voids were observed in the bonded article having the Si chip bonded to the copper substrate which was not plated with silver, and the Si chip was not satisfactorily bonded to the substrate thereof.

The producing conditions and characteristics of the bonding materials in these examples and comparative examples are shown in Tables 1-2. In Table 1, "o" is shown if no voids were observed in each of the bonded articles, "x" is shown if voids were observed in each of the bonded articles, and "Δ" is shown if voids were observed in the bonded article having the Si chip to the copper substrate which was not plated with silver although no voids were observed in the bonded article having the Si chip bonded to the silver-plated copper substrate.

TABLE 1

| | Silver Particles in Silver Paste (% by weight) | | | Weight Percentage in Silver Particles (% by weight) | | |
|---|---|---|---|---|---|---|
| | Small Particles | Medium ticles | Large Par-Particles | Small Par-ticles | Medium Par-ticles | Large Particles |
| Ex. 1 | 14.5 | 7.5 | 70 | 16 | 8 | 76 |
| Ex. 2 | 14.5 | 0 | 77.5 | 16 | 0 | 84 |
| Ex. 3 | 19.78 | 0 | 72.22 | 22 | 0 | 78 |
| Ex. 4 | 14.5 | 12.5 | 65 | 16 | 14 | 71 |

TABLE 1-continued

| | Silver Particles in Silver Paste (% by weight) | | | Weight Percentage in Silver Particles (% by weight) | | |
|---|---|---|---|---|---|---|
| | Small Particles | Medium ticles | Large Par-Particles | Small Par-ticles | Medium Par-ticles | Large Particles |
| Ex. 5 | 14.75 | 14.75 | 62.5 | 16 | 16 | 68 |
| Ex. 6 | 12.5 | 7.5 | 72 | 14 | 8 | 78 |
| Ex. 7 | 7.25 | 7.25 | 77.5 | 8 | 8 | 84 |
| Ex. 8 | 14.5 | 26.8 | 50.7 | 16 | 29 | 55 |
| Ex. 9 | 14.5 | 17.5 | 60 | 16 | 19 | 65 |
| Ex. 10 | 7.5 | 9.75 | 74.75 | 8 | 11 | 81 |
| Ex. 11 | 4.5 | 7.5 | 80 | 5 | 8 | 87 |
| Ex. 12 | 27.6 | 0 | 64.4 | 30 | 0 | 70 |
| Ex. 13 | 27.6 | 18.4 | 46 | 30 | 20 | 50 |
| Ex. 14 | 2.3 | 2.3 | 87.4 | 2.5 | 2.5 | 95 |
| Ex. 15 | 14.5 | 7.5 | 70 | 16 | 8 | 76 |
| Comp. 1 | 4.5 | 17.5 | 70 | 5 | 19 | 76 |
| Comp. 2 | 9.2 | 27.6 | 55.2 | 10 | 30 | 60 |
| Comp. 3 | 27.6 | 27.6 | 36.8 | 30 | 30 | 40 |
| Comp. 4 | 46 | 9.2 | 36.8 | 50 | 10 | 40 |

TABLE 2

| | Viscosity (Pa · s) | | | |
|---|---|---|---|---|
| | $2\ s^{-1}$ | $20\ s^{-1}$ | Ti | Voids |
| Ex. 1 | 309 | 26 | 11.7 | ○ |
| Ex. 2 | 712 | 49 | 14.6 | ○ |
| Ex. 3 | 1034 | 47 | 22.0 | ○ |
| Ex. 4 | 357 | 22 | 16.0 | ○ |
| Ex. 5 | 287 | 25 | 11.6 | ○ |
| Ex. 6 | 211 | 17 | 12.4 | ○ |
| Ex. 7 | 118 | 15 | 8.1 | ○ |
| Ex. 8 | 28 | 9 | 3.0 | Δ |
| Ex. 9 | 96 | 20 | 4.8 | Δ |
| Ex. 10 | 86 | 13 | 6.6 | ○ |
| Ex. 11 | 62 | 13 | 4.7 | ○ |
| Ex. 12 | 2135 | 127 | 16.9 | ○ |
| Ex. 13 | 2186 | 96 | 22.8 | Δ |
| Ex. 14 | 37 | 11 | 3.4 | ○ |
| Ex. 15 | 826 | 69 | 12.0 | |
| Comp. 1 | 20 | 8 | 2.4 | x |
| Comp. 2 | 13 | 7 | 1.7 | x |
| Comp. 3 | — | — | — | Δ |
| Comp. 4 | — | — | — | Δ |

As can be seen from these results, in all of the bonding materials in Examples 1-15, the weight percentages of the first silver particles (small particles), second silver particles (medium particles) and third silver particles (large particles) are 1.4 to 49% by weight, 36% by weight or less, and 50 to 95% by weight, respectively, with respect to the total 100% by weight of the silver particles, and the weight ratio of the first silver particles (small particles) to the second silver particles (medium particles) is 14/36 or more. On the other hand, in all of the bonding materials in Comparative Example 1-4, the weight percentages and the weight ratio are not in such ranges. That is, in all of the bonding materials in Examples 1-15, the weight percentages (% by weight) of the first silver particles (small particles), second silver particles (medium particles) and third silver particles (large particles) are in a pentagonal region (containing the outline of the pentagonal region) obtained by connecting a point a (49, 1, 50), a point b (14, 36, 50), a point c (1.4, 3.6, 95), a point d (5, 0, 95) and a point e (49, 0, 51) by straight lines in this order, the points a, b, c, d and e being arranged on the coordinates of a triangle (triangular coordinates) shown in FIG. 1. On the other hand, in all of the bonding materials in Comparative Example 1-4, the weight percentages (% by weight) of the small, medium and large particles are out of the pentagonal region.

Furthermore, as shown in Tables 1 and 2, in Examples 8, 9 and 13 wherein the weight percentage of the second silver particles (medium particles) in the silver particles of the bonding material is 19% by weight or more, voids were observed in the bonded article having the Si chip bonded to the copper substrate which was not plated with silver although no voids were observed in the bonded article having the Si chip bonded to the silver-plated copper substrate. Therefore, it can be seen that the weight percentage of the second silver particles (medium particles) in the silver particles of the bonding material is preferably less than 19% by weight. In addition, it can be seen from the comparison of Example 2 with Examples 1, 4, 5, 8 and 9 that the weight percentage of the third silver particles (large particles) is decreased to lower the viscosity of the bonding material if the second silver particles (medium particles) are added to the bonding material. If the viscosity of the bonding material is thus lowered, the printability of the bonding material is caused to be good, so that the handling of the bonding material is caused to be good. For that reason, the second silver particles (medium particles) are preferably added to the bonding material. Moreover, it can be seen from the comparison of Example 12 with Example 13 that the viscosity of the bonding material is not lowered even if the second silver particles (medium particles) to the bonding material when the weight percentage of the first silver particles (small particles) in the silver particles of the bonding material is increased to be 30% by weight. Furthermore, it can be seen from the comparison of Example 1 with Example 15 that the viscosity of the bonding material is increased if the second silver particles (medium particles) and the third silver particles (large particles) are coated with an organic compound having the same carbon number (sorbic acid having a carbon number of 6) as shown in Example 15. For that reason, the carbon number of the organic compound coating the third silver particles (large particles) is preferably larger than the carbon number of the organic compound coating the second silver particles (medium particles) (the organic compound coating the third silver particles preferably has a longer main chain in its molecule than that of the organic compound coating the second silver particles).

The invention claimed is:

1. A bonding material of a metal paste consisting of:

metal particles which contain first metal particles having an average primary particle diameter of 1 to 40 nm, second metal particles having an average primary particle diameter of 41 to 110 nm, and third metal particles having an average primary particle diameter of 120 nm to 10 μm, each of the first metal particles being coated with hexanoic acid, each of the second metal particles being coated with sorbic acid, each of the third metal particles is coated with oleic acid;

a polar solvent; and a dispersant which is one or more selected from the group consisting of carboxylic acid dispersants and phosphate ester dispersants, wherein the weight percentages of the first, second and third metal particles are 1.4 to 49% by weight, 2 to 36% by weight, and 50 to 95% by weight, respectively, with respect to the total 100% by weight of the metal particles, and the weight ratio of the first metal particles to the second metal particles is 14/36 or more, and wherein the total content of the metal particles in the bonding material is 92 to 97% by weight.

2. A bonding material as set forth in claim 1, wherein the weight percentage of said first metal particles being 1.4 to 25% by weight with respect to the total 100% by weight of said metal particles.

3. A bonding material as set forth in claim 1, wherein said polar solvent is one or more selected from the group consisting of 1-decanol, 1-dodecanol, 2-ethyl-1,3-hexanediol and 2-methyl-butane-1,3,4-triol.

4. A bonding material as set forth in claim 1, wherein said metal particles are gold particles, silver particles, copper particles or nickel particles.

5. A bonding material as set forth in claim 1, wherein said metal particles are silver particles or copper particles.

6. A bonding material as set forth in claim 1, wherein said metal particles are silver particles.

7. A bonding material as set forth in claim 1, wherein the weight percentage of said second metal particles is 2 to 17% by weight with respect to the total 100% by weight of said metal particles.

8. A bonding material of a metal paste consisting of:

metal particles which contain first metal particles having an average primary particle diameter of 1 to 40 nm, second metal particles having an average primary particle diameter of 41 to 110 nm, and third metal particles having an average primary particle diameter of 120 nm to 10 μm, each of the first metal particles being coated with a first organic compound having a carbon number of not greater than 8, each of the second metal particles being coated with a second organic compound having a carbon number of not greater than 8, each of the third metal particles is coated with a third organic compound having a carbon number of not less than 9;

a polar solvent; and a dispersant which is one or more selected from the group consisting of carboxylic acid dispersants and phosphate ester dispersants, wherein the weight percentages of the first, second and third metal particles are 1.4 to 49% by weight, 2 to 36% % by weight, and 50 to 95% by weight, respectively, with respect to the total 100% by weight of the metal particles, and the weight ratio of the first metal particles to the second metal particles is 14/36 or more, and wherein the total content of the metal particles in the bonding material is 92 to 97% by weight.

9. A bonding material as set forth in claim 8, wherein the weight percentage of said first metal particles being 1.4 to 25% by weight with respect to the total 100% by weight of said metal particles.

10. A bonding material as set forth in claim 8, wherein each of said first and second organic compounds is a saturated or unsaturated fatty acid having a carbon number of 1 to 6.

11. A bonding material as set forth in claim 8, wherein each of said first and second organic compounds is hexanoic acid or sorbic acid.

12. A bonding material as set forth in claim 8, wherein said polar solvent is one or more selected from the group consisting of 1-decanol, 1-dodecanol, 2-ethyl-1,3-hexanediol and 2-methyl-butane-1,3,4-triol.

13. A bonding material as set forth in claim 8, wherein said metal particles are gold particles, silver particles, copper particles or nickel particles.

14. A bonding material as set forth in claim 8, wherein said metal particles are silver particles or copper particles.

15. A bonding material as set forth in claim 8, wherein said metal particles are silver particles.

16. A bonding material as set forth in claim 8, wherein the weight percentage of said second metal particles is 2 to 17% by weight with respect to the total 100% by weight of said metal particles.

17. A bonding method comprising the steps of:

arranging a bonding material, as set forth in claim 1, between articles; and heating the bonding material to sinter a metal therein to form a metal bonding layer to bond the articles to each other with the metal bonding layer.

* * * * *